US006093053A

United States Patent [19]

Horioka et al.

[11] Patent Number: 6,093,053

[45] Date of Patent: Jul. 25, 2000

[54] ELECTRIC COMPONENT WITH SOLDERING-LESS TERMINAL FITMENT

[75] Inventors: Yasuaki Horioka; Hirokazu Kotani, both of Osawano-machi, Japan

[73] Assignee: Hokuriku Electric Industry Co., Ltd., Toyama Pref., Japan

[21] Appl. No.: 09/160,662

[22] Filed: Sep. 25, 1998

[30] Foreign Application Priority Data

Sep. 25, 1997 [JP] Japan ..... 9-259550
Sep. 21, 1998 [JP] Japan ..... 10-266074

[51] Int. Cl.[7] ..... H01R 4/26

[52] U.S. Cl. ..... 439/444; 439/81

[58] Field of Search ..... 439/441, 437, 439/438, 444

[56] References Cited

U.S. PATENT DOCUMENTS

| | | | |
|---|---|---|---|
| 3,122,604 | 2/1964 | Cook et al. | 439/437 |
| 4,471,339 | 9/1984 | Fukada et al. | 338/162 |
| 5,373,101 | 12/1994 | Barabolak | 174/35 |
| 5,546,280 | 8/1996 | Hasebe et al. | 361/752 |

FOREIGN PATENT DOCUMENTS

| | | | |
|---|---|---|---|
| 0555472 | 4/1977 | U.S.S.R. | 439/438 |

*Primary Examiner*—Gary F. Paumen
*Assistant Examiner*—Briggitte R. Hammond
*Attorney, Agent, or Firm*—Pearne & Gordon LLP

[57] ABSTRACT

An electric component with a soldering-less terminal fitment capable of preventing a contact portion of the terminal fitment from being detached from an electrode on a surface of a circuit board due to slippage thereof on the circuit board. A terminal fitment arranged between a circuit board and an insulating casing includes a connection conductor holding section and a contact terminal section having a proximal portion formed integrally with the connection conductor holding section. The contact terminal section includes a contact portion, which is pressedly contacted with an electrode on the circuit board by elasticity. The contact terminal section includes a curved portion which is curved in a manner to be projected in a direction of insertion of a connection conductor through the terminal fitment and provided on a distal end thereof with the contact portion. The contact portion is constituted by a biting element. The biting element is so inclined that a distal end thereof is positioned on a projected side of the curved portion as compared with a proximal portion thereof.

7 Claims, 2 Drawing Sheets

ELECTRIC COMPONENT WITH SOLDERING-LESS TERMINAL FITMENT

BACKGROUND OF THE INVENTION

This invention relates to an electric component with a soldering-less terminal fitment, and more particularly to an electric component with a terminal fitment which permits connection of a connection conductor without soldering.

Use of flon is subject to restriction in view of environmental pollution, so that it is highly required to connect a terminal conductor, a lead wire or the like to a connection electrode of a circuit board without soldering. This is likewise true of an electric component called a focus pack used for adjustment of a focus voltage of a cathode ray tube (CRT), a screen voltage thereof or the like.

U.S. Pat. No. 4,471,339 discloses a high-voltage variable resistor unit including a terminal connection structure for connecting, by means of a terminal fitment like a coiled spring provided at one end thereof with a ring into which a connection conductor or connection terminal is inserted, a connection electrode of the resistor unit to the connection terminal without soldering. Such a conventional terminal fitment as taught in the U.S. patent fails to firmly hold the connection terminal therein, to thereby cause the connection terminal to be readily released or detached from the terminal fitment. Also, it tends to cause a failure in electrical connection between the connection terminal and the terminal fitment. Further, the above-described construction of the terminal fitment requires to keep the connection terminal and connection electrode connected together prior to incorporation of a circuit board in an insulating casing. This, when use of a lead wire of an increased length is required for the connection conductor, causes the long lead wire to obstruct assembling of the high-voltage variable resistor unit. In particular, when the high-voltage variable resistor unit including the terminal connection structure is combined with a fly-back transformer, the high-voltage variable resistor must be placed in a heating oven together with the long lead wire for the purpose of subjecting a resin material for molding of the fly-back transformer to heat curing. Unfortunately, the long lead wire renders the operation highly troublesome and requires to provide a space sufficient to receive the long lead wire therein in the heating oven, leading to a deterioration in production efficiency.

In order to solve the problem, the assignee proposed an electronic or electric component including a terminal fitment for connecting a core of a lead wire to a connection electrode of a circuit board without using any soldering, as disclosed in U.S. Pat. No. 5, 546, 280, which corresponds to Japanese Patent Application Laid-Open Publication No. 318669/1994. The terminal fitment disclosed includes a connection conductor holding section and a contact terminal section of which a proximal portion is formed in a manner to be integral with the connection conductor holding section. The contact terminal section includes a contact portion pressedly contacted with an electrode of the circuit board by elasticity. The contact terminal section includes a curved portion which is projectedly curved in a direction of insertion of the connection conductor therethrough, to thereby provide the contact portion.

Unfortunately, the electric component disclosed in the U.S. patent causes the contact portion on a free end of the contact terminal section to be detached from the electrode on the circuit board due to slippage thereof on the electrode, resulting in a failure in contact often occurring.

SUMMARY OF THE INVENTION

The present invention has been made in view of the foregoing disadvantages of the prior art.

Accordingly, it is an object of the present invention to provide an electric component with a soldering-less terminal fitment which is capable of preventing a contact portion of a contact terminal section of the terminal fitment from being detached from an electrode on a surface of a circuit board due to slippage thereof on the circuit board when the terminal fitment is interposedly arranged between an insulating casing and the circuit board.

It is another object of the present invention to provide an electric component with a soldering-less terminal fitment which is capable of positively arranging the terminal fitment between an insulating casing and a circuit board.

In accordance with the present invention, an electric component with a soldering-less terminal fitment is provided. The electric component includes a circuit board provided on a front surface thereof with at least one circuit pattern including electrodes and an insulating casing including an inner surface and a peripheral wall. The insulating casing has the circuit board received therein so as to form a space between the front surface of the circuit board and the inner surface of the insulating casing and surround an outer periphery of the circuit board with the peripheral wall of the insulating casing. The peripheral wall of the insulating casing is formed with a through-hole via which a connection conductor is inserted into the space of the insulating casing. The electric component also includes a terminal fitment arranged between each of the electrodes on the circuit board and the inner surface of the insulating casing. The terminal fitment includes a connection conductor holding section for holding an end of the connection conductor inserted into the space via the through-hole without soldering and a contact terminal section formed in a manner to be integral with the connection conductor holding section and including a contact portion contacted with the electrode. The contact terminal section includes a curved portion formed so as to be projected in a direction apart from the peripheral wall of the insulating casing through which the through-hole is formed or in a direction of insertion of the connection conductor through the terminal fitment. The curved portion is provided so as to exhibit elasticity sufficient to forcedly press the contact portion of the contact terminal section against the electrode when it is kept compressed.

In the present invention, the contact portion of the contact terminal section is formed by raising a portion of the contact terminal section positioned at a distal end of the curved portion toward the front surface of the circuit board, to thereby provide at least one biting element having a distal end adapted to bite into the electrode. The biting element is so inclined that the distal end thereof is positioned on a projected side of the curved portion as compared with a proximal portion thereof. Thus, the biting element is raised so that the distal end thereof is positioned on the projected side of the curved portion as compared with the proximal portion thereof.

Such construction permits the biting element to bite into the electrode to prevent the contact portion from being detached from the electrode while being slid on the electrode. In particular, formation of the biting element in a manner to position the distal end thereof on the projected side of the curved portion as compared with the proximal portion thereof exhibits significant advantages. More particularly, elasticity of the curved portion of the contact terminal section of the terminal fitment permits the biting element to positively bite into the electrode when the curved portion is compressed or deformed so as to approach both ends of the curved portion to each other during assembling of the electric component, to thereby keep the contact portion from being released from the electrode.

The terminal fitment is preferably integrally formed of a single conductive metal plate. This facilitates formation of the terminal fitment and reduces a number of parts required, leading to a reduction in cost of the electric component. Also, it facilitates incorporation of the terminal fitment into the insulating casing.

The connection conductor holding section may be constructed in any desired manner. Typically, the connection conductor holding section includes a flat plate portion having a plate surface arranged opposite to an opening of the through-hole facing the space and a plurality of biting sections formed by raising the flat plate portion in a direction of insertion of the connection conductor through the flat plate portion. The biting sections are formed into a shape which permits the end of the connection conductor to be interposedly held therebetween and the biting sections to bite into the end of the connection conductor when force is applied to the connection conductor in a direction in which the connected conductor is drawn out of the connection conductor holding section. In such a case, the curved portion of the contact terminal section and the biting element each have a plate surface contiguous to the plate surface of the flat plate portion and are formed at a proximal portion thereof with a plate-like portion of an elongated shape in a manner to be contiguous to the flat plate portion by mechanical processing. More specifically, the plate-like portion is formed at a distal end thereof with a punched hole for providing the biting element of which a distal portion is arranged on the distal end of the plate-like portion. Also, the contact terminal section further includes a pair of interposing portions arranged outside the punched hole to interpose the biting element therebetween and bent toward the distal end of the plate-like portion, so that the biting element may be outwardly projected from the punched hole. Such construction prevents the proximal portion of the biting element from being formed with any bent portion during formation of the biting element. This permits an increase in mechanical strength of the biting element, to thereby substantially prevent deformation of the biting element during assembling of the electric component. If the bent portion is provided at the proximal portion of the biting element, application of increased force to the biting element causes the biting element to be readily bent at the bent portion, to thereby render the assembling troublesome.

In order to adjust elasticity of the curved portion, the plate-like portion may be formed at a portion thereof positionally corresponding to the curved portion thereof with a slit of an elongated shape in a manner to extend in a longitudinal direction thereof. In this instance, the slit is formed so as to communicate with the punched hole. This facilitates formation of the slit and punched hole. Also, this permits the punched hole to constitute a part of the slit, to thereby increase a range of adjustment of the elasticity.

The biting element is preferably formed into a length and an inclination angle which permit it to be positioned at the distal end thereof in a virtual plane defined so as to be parallel to the plate surface of the flat plate portion and be in a plane of the flat plate portion. This ensures positive biting of the biting element into the electrode during compression of the curved portion.

BRIEF DESCRIPTION OF THE DRAWINGS

These and other objects and many of the attendant advantages of the present invention will be readily appreciated as the same becomes better understood by reference to the following detailed description when considered in connection with the accompanying drawings, in which like reference numerals designate like or corresponding parts throughout; wherein.

DETAILED DESCRIPTION OF THE PREFERRED EMBODIMENT

Now, an electric component with a soldering-less terminal fitment according to the present invention will be described hereinafter with reference to the accompanying drawings.

Figure 1:
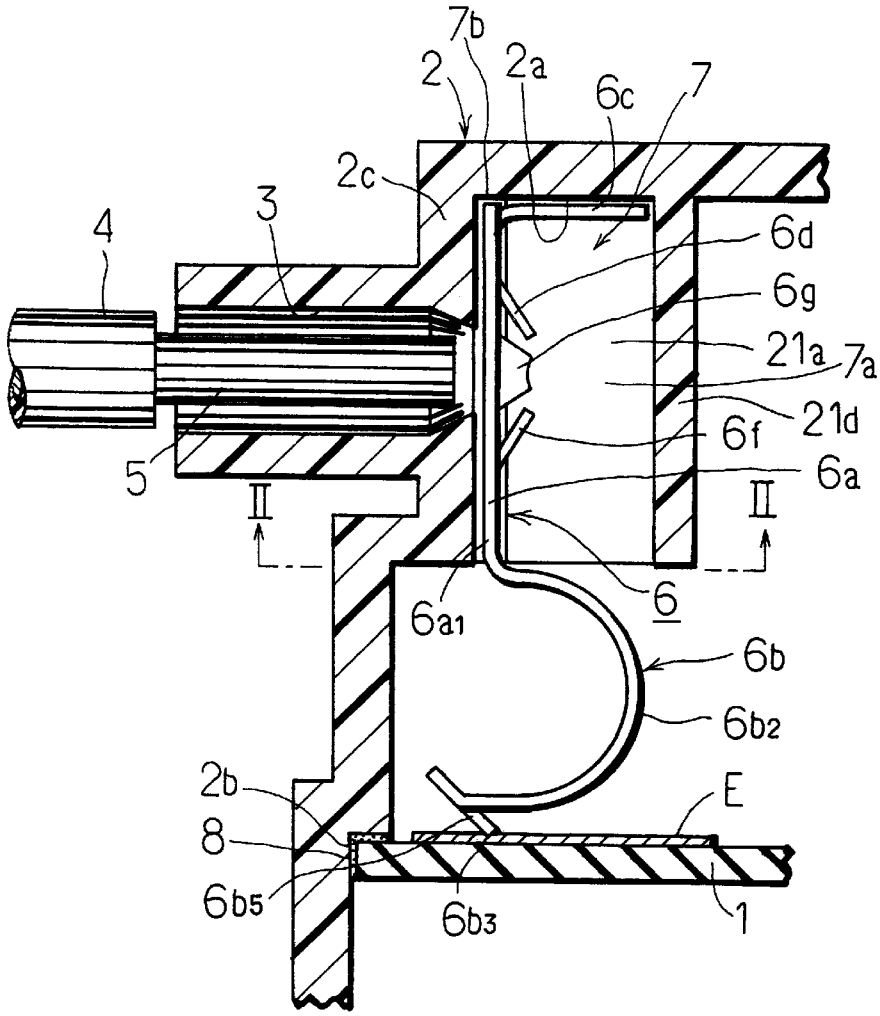
FIG. 1 is a fragmentary vertical sectional view showing an essential part of an embodiment of an electrical component according to the present invention.
Figure 2:
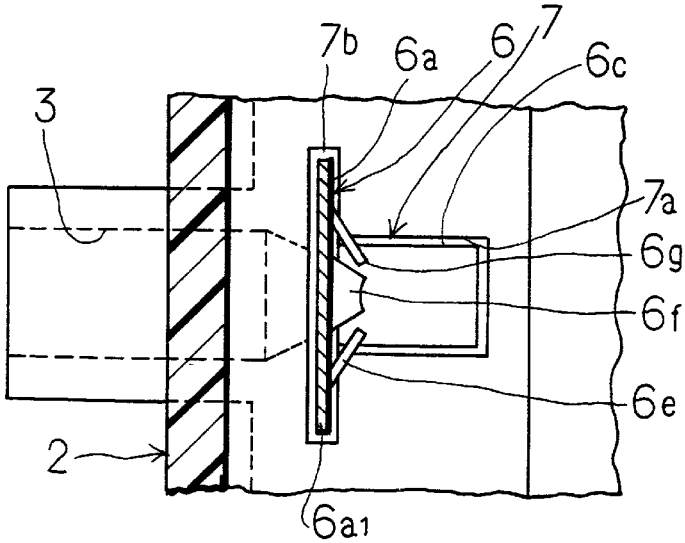
FIG. 2 is a fragmentary sectional view taken along line II—II of FIG. 1.
Figure 3A:
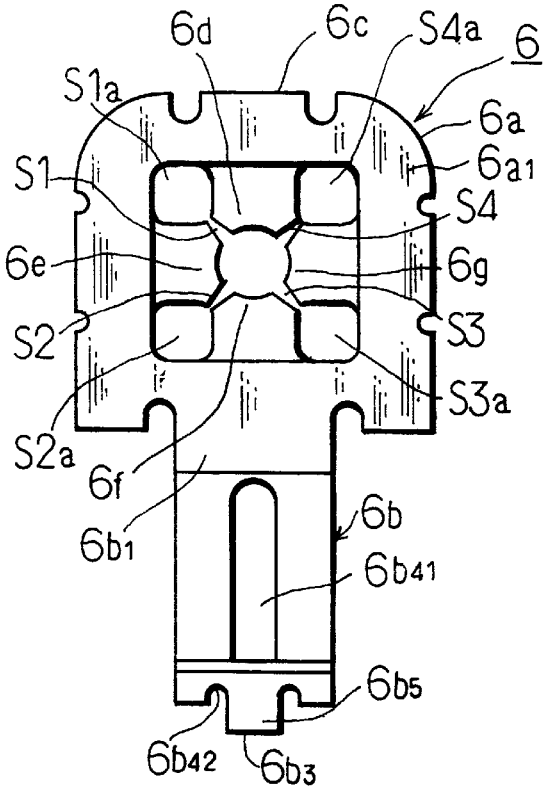
FIG. 3A is a front elevation view showing a terminal fitment incorporated in the electrical component shown in FIG. 1.
Figure 3B:
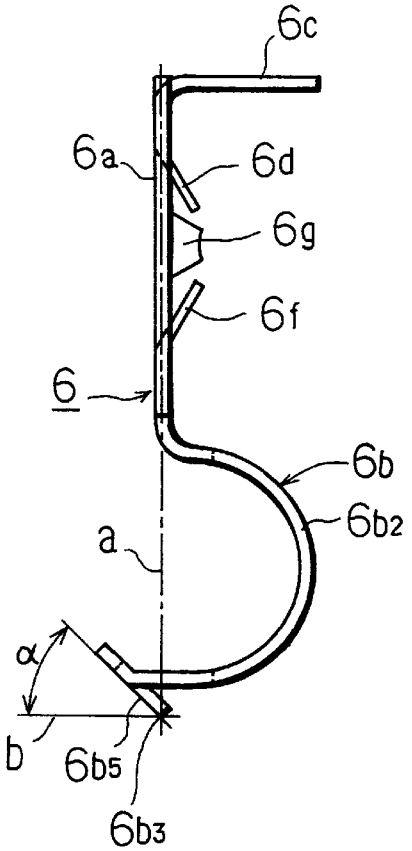
FIG. 3B is a right side view of the terminal fitment shown in FIG. 3A.
Figure 3C:
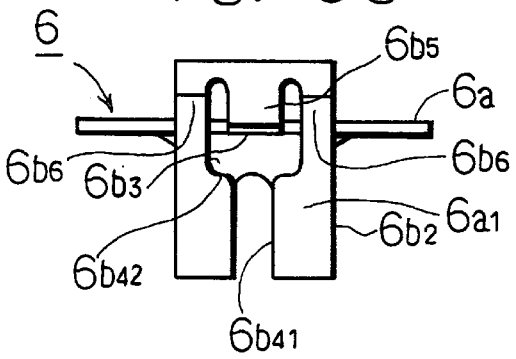
FIG. 3C is a bottom view of the terminal fitment shown in FIG. 3A.

Referring first to FIGS. 1 to 3C, an embodiment of an electrical component according to the present invention is illustrated, which is realized in the form of a high-voltage variable resistor unit. The high-voltage variable resistor unit, as shown in FIG. 1, includes a circuit board 1 constituted by a ceramic substrate which is formed on a front surface thereof with at least one variable resistance circuit pattern including a plurality of electrodes and variable resistances. In FIG. 1, of the plural electrodes, only one electrode E electrically contacted with a terminal fitment 6, which will be described hereinafter, is illustrated for the sake of brevity. The electrode E may be a thick-film electrode made of, for example, a conductive paste prepared by mixing a glass paste material with a silver powder. Reference numeral 2 designates an insulating casing formed on one side thereof with an opening. In the illustrated embodiment, the opening is formed on a lower side of the insulating casing 2. The insulating casing 2 is provided therein with a step or rib 2*b*, onto which the circuit board 1 is joined at an outer periphery thereof by means of an epoxy adhesive 8. This results in the circuit board 1 being firmly arranged in the insulating casing 2 so as to define a space between the front surface of the circuit board 1 and an inner surface 2*a* of the insulating casing 2. The insulating casing 2 is formed at a peripheral wall 2*c* thereof surrounding the outer periphery of the circuit board 1 with a through-hole 3 via which a core of a lead wire 4 or an end of a connection conductor 5 is guided into the insulating casing 2.

The insulating casing 2 is provided therein with the terminal fitment 6, which is arranged in a manner to be interposed between the front surface of the circuit board 1 and the inner surface 2*a* of the insulating casing. More specifically, the terminal fitment 6 includes a connection conductor holding section 6*a* fitted in a terminal fitment fit section 7 arranged in the insulating casing 2. The terminal fitment fit section 7 is formed with a connection conductor insertion space 7*a* in a manner to communicate with the through-hole 3 formed via the peripheral wall of the insulating casing 2. Also, the connection conductor insertion space 7*a* is formed so as to be open on a side thereof facing the opening of the insulating casing 2 or the front surface of the circuit board 1. Also, the terminal fitment fit section 7 is formed with a fit groove 7b in a manner to be perpendicular to the connection conductor insertion space 7a. The fit groove 7b is fitted therein with a flat plate portion 6a1 of the connection conductor holding section 6a of the terminal fitment 6.

The terminal fitment 6 includes the connection conductor holding section 6a for holding the connection conductor 5 thereon, a contact terminal section 6b provided integrally with the connection conductor holding section 6a and a plate-like section 6c arranged opposite to the contact terminal section 6b and having a plate surface extending in a direction perpendicular to a plate surface of the flat plate portion 6a1 of the connection conductor holding section 6a. The terminal fitment 6 is made of a conductive metal plate such as stainless steel, bronze or the like by mechanical processing such as pressing, bending or the like and constructed so as to permit the connection conductor 5 to be electrically connected to the electrode E without soldering. The conductive metal plate is preferably subject to bending, to thereby exhibit elasticity to a degree. For this purpose, it may be made of, for example, SUS 301 stainless steel of 0.1 to 0.4 mm in thickness, bronze of 0.2 to 0.5 mm in thickness or the like.

The connection conductor holding section 6a includes the plate section 6a1 formed into a substantially rectangular shape. The flat plate section 6a1 is formed with four slits SI to S4 in a manner to extend from a center thereof toward four corners thereof. This results in four biting elements 6d to 6g being formed between the respective adjacent slits S1 to S4, each of which bites into an outer surface or periphery of the connection conductor 5 inserted through the connection conductor holding section 6a. The slits S1 to S4 are formed at a proximal end thereof with holes S1*a* to S4*a* having a diameter considerably larger than a width of the slits S1 to S4, respectively. The biting sections 6d to 6g are raised at a distal end thereof in a direction in which the connection conductor 5 is inserted through the connection conductor holding section 6a, resulting in being inclined. An angle at which the biting sections 6d to 6g are inclined is so set that a distance between two biting sections 6d and 6f or 6e and 6g opposite to each other is smaller than a diameter of the connection conductor 5. Such inclination of the biting sections 6d to 6g permits the connection conductor 5 to be positioned at the center of the connection conductor holding section 6a and facilitates insertion of the connection conductor 5 through the connection conductor holding section 6a. So long as the connection conductor 5 has hardness increased to a degree, it is not necessarily required to keep the biting sections 6d to 6g inclined because the connection conductor 5 increased in hardness can be inserted through the connection conductor holding section 6a while forcing the biting sections 6d to 6g. The biting sections 6d to 6g are cut at a distal end thereof into an arcuately recessed shape, resulting in readily biting into the outer periphery of the connection conductor. When the connection conductor 5 is inserted through the connection conductor holding section 6a while forcedly expanding the biting sections 6d to 6g, the connection conductor 5 is clamped by the biting sections 6d to 6g, resulting in being electrically connected thereto. When force acting to draw out the connection conductor 5 from the connection conductor holding section 6a is applied to the connection conductor 5, the biting sections 6d to 6g are permitted to bite deeply into the outer periphery of the connection conductor 5, to thereby keep the connection conductor 5 from being readily released from the connection conductor holding section 6a. Thus, the connection conductor 5 is positively electrically connected to the terminal fitment 6 without soldering.

The contact terminal section 6b includes an elongated plate-like portion 6b1 having a plate surface contiguous to the plate surface of the flat plate portion 6a1 of the connection conductor holding section 6a and connected at a proximal portion thereof to the flat-plate portion 6a1. The plate-like portion 6b1 is formed with a curved portion 6b2 and a contact portion 6b3 by mechanical processing such as pressing, bending or the like. The curved portion 6b2 is curvedly formed so that the elongated plate-like portion 6b1 is arcuately projected in a direction apart from the peripheral wall 2c of the insulating casing 2 through which the through-hole 3 is formed. The curved portion 6b2 is formed with a slit 6b41, which is arranged so as to extend in a longitudinal direction of the elongated plate-like portion 6b1. The plate-like portion 6b1 is formed at a distal end thereof with a punched hole 6b42, resulting in a single biting element 6b5 being provided at the distal end of the plate-like portion 6b1. In the illustrated embodiment, the punched hole 6b42 is arranged so as to communicate with the slit 6b41.

The contact terminal section 6b also includes a pair of interposing portions 6b6 arranged outside the punched hole 6b42 to interpose the biting element 6b5 therebetween. The interposing portions 6b are bent toward the distal end of the plate-like portion 6b1, so that the biting element 6b5 may be outwardly projected from the punched hole 6b42. In the illustrated embodiment, the biting element 6b5 constitutes the contact portion 6b3 which bites into the electrode E. In other words, the biting element 6b5 constituting the contact portion 6b3 is formed by outwardly raising a portion thereof surrounded by the punched hole 6b42 formed at the distal end of the plate-like portion 6b1. The biting element 6b5 is so formed that a distal end thereof is positioned on a projected side of the projection of the curved portion 6b2 as compared with a proximal portion thereof. In the illustrated embodiment, the biting element 6b5 is formed into a length and an angle $\alpha$ which permit the distal end of the biting element 6b5 to be positioned in a virtual plane a defined so as to extend in parallel to the plate surface of the flat plate portion 6a1 of the connection conductor holding section 6a and be in a plane of the flat plate portion 6a1. The angle $\alpha$ is defined to be an angle between a virtual perpendicular plane b perpendicular to the virtual plane a and the biting element 6b 5 or between the virtual plane a and the biting element 6b5. The angle $\alpha$ is preferably set to be about 45 degrees.

The plate-like section 6c is arranged so as to extend across the plate surface of the flat plate 6a1 on a side thereof opposite to a side thereof on which the contact terminal section 6b is arranged. The plate-like section 6c is contacted with a deep surface of the connection conductor insertion space 7a constituting a part of the inner surface of the insulating casing 2, to thereby stably hold the terminal fitment 6 therein.

For assembling of the high-voltage variable resistor unit or electric component, firstly the insulating casing 2 is placed while keeping the opening facing up. Then, the terminal fitment 6, an operation shaft (not shown) and a slider (not shown) are received in the insulating casing 2 and then the circuit board 1 is joined onto the rib 2b of the insulating casing 2. At this time, the curved portion 6b2 of the contact terminal section 6b of the terminal fitment 6 is compressed or deformed so that both ends of the curved portion 6b2 are approached to each other. The biting element 6b5 bites at the distal end thereof into the electrode E, to thereby prevent the contact portion 6b3 constituted by the biting element 6b5 from being released from the electrode E. Also, the contact portion 6b3 of the contact terminal section

6*b* is elastically pressed against the electrode on the circuit board 1, so that the terminal fitment 6 may be electrically connected to the electrode E of the circuit board 1 without soldering.

Figure 4:
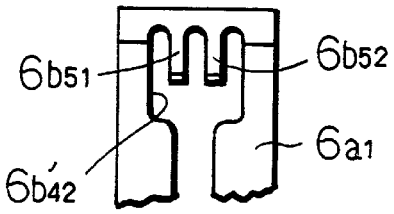
FIG. 4 is a bottom view showing a modification of the terminal fitment of FIG. 3A.

In the illustrated embodiment, the contact terminal section 6*b* is provided with the single biting element 6*b*5. Alternatively, two or more biting elements 6*b*51 and 6*b*52 may be provided at the distal end of the contact terminal section 6*b* as shown in FIG. 4.

As can be seen from the foregoing, in the present invention, the contact portion of the contact terminal section is constituted by at least one biting element, to thereby be prevented from being detached from the electrode due to slippage thereof on the electrode because it effectively bites into the electrode. In particular, when the biting element 6*b*5 is so formed that the distal end thereof is positioned on the projected side of the curved portion 6*b*2 as compared with the proximal portion thereof, it is ensured that the biting element positively bites at the distal end thereof into the electrode due to elasticity of the curved portion of the contact terminal section of the terminal fitment when the curved portion is compressed during assembling of the electric component.

While preferred embodiment of the invention have been described with a certain degree of particularity with reference to the accompanying drawings, obvious modifications and variations are possible in light of the above teachings. It is therefore to be understood that within the scope of the appended claims, the invention may be practiced otherwise than as specifically described.

What is claimed is:

1. An electric component with a soldering-less terminal fitment, comprising:

a circuit board provided on a front surface thereof with at least one circuit pattern including electrodes;

an insulating casing including an inner surface and a peripheral wall;

said insulating casing having said circuit board received therein so as to form a space between said front surface of said circuit board and said inner surface of said insulating casing and surround an outer periphery of said circuit board with said peripheral wall of said insulating casing;

said peripheral wall of said insulating casing being formed with a through-hole via which a connection conductor is inserted into said space of said insulating casing; and a terminal fitment including a connection conductor holding section arranged between each of said electrodes on said circuit board and said inner surface of said insulating casing to hold an end of the connection conductor inserted into said space via said through-hole without soldering and a contact terminal section formed integrally with said connection conductor holding section and including a contact portion contacted with said electrode;

said contact terminal section including a curved portion formed so as to be projected in a direction apart from said peripheral wall of said insulating casing through which said through-hole is formed;

said curved portion being provided so as to exhibit elasticity to forcedly press said contact portion of said contact terminal section against said electrode when it is kept compressed;

said contact portion of said contact terminal section being formed by raising a portion of said contact terminal section positioned at a distal end of said curved portion toward said front surface of said circuit board, to thereby provide at least one biting element having a distal end biting into said electrode;

said biting element being so inclined that said distal end thereof is positioned on a projected side of said curved portion as compared with a proximal portion thereof;

said connection conductor holding section includes a flat plate portion having a plate surface arranged opposite to an opening of said through-hole facing said space and a plurality of biting sections formed by raising said flat plate portion in a direction of insertion of the connection conductor through said flat plate portion;

said biting sections being formed into a shape which permits the end of the connection conductor to be interposedly held therebetween and said biting sections to bite into the end of the connection conductor when force is applied to the connection conductor in a direction in which the connected conductor is drawn out of said connection conductor holding section;

said curved portion of said contact terminal section and said biting element each have a plate surface contiguous to said plate surface of said flat plate portion and are so formed that a plate-like portion in an elongated shape which is contiguous to said flat plate portion is machined;

said plate-like portion being formed at a distal end thereof with a punched hole for providing said biting element of which a distal portion is arranged on said distal end of said plate-like portion; and said contact terminal section further includes a pair of interposing portions arranged outside said punched hole to interpose said biting element therebetween and bent toward said distal end of said plate-like portion, so that said biting element may be outwardly projected from said punched hole.

2. The electric component as defined in claim 1, wherein said plate-like portion is formed at a portion thereof positionally corresponding to said curved portion thereof with a slit of an elongated shape so as to extend in a longitudinal direction thereof;

said slit being formed so as to communicate with said punched hole.

3. The electric component as defined in claim 1, wherein said biting element is positioned at said distal end thereof in a virtual plane defined so as to be parallel to said plate surface of said flat plate portion and be in a plane of said flat plate portion.

4. An electric component with a soldering-less terminal fitment, comprising:

a circuit board provided on a front surface thereof with at least one circuit pattern including electrodes;

an insulating casing including an inner surface and a peripheral wall;

said insulating casing having said circuit board received therein so as to form a space between said front surface of said circuit board and said inner surface of said insulating casing and surround an outer periphery of said circuit board with said peripheral wall of said insulating casing;

said peripheral wall of said insulating casing being formed with a through-hole via which a connection conductor is inserted into said space of said insulating casing; and a terminal fitment including a connection conductor holding section arranged between each of said electrodes on said circuit board and said inner surface of said insulating casing to hold an end of the connection conductor inserted into said space via said through-hole without soldering and a contact terminal section formed integrally with said connection conductor holding section and including a contact portion contacted with said electrode;

said connection conductor holding section including a flat plate portion having a plate surface arranged opposite to an opening of said through-hole facing said space and a plurality of biting sections formed by raising said flat plate portion in a direction of insertion of the connection conductor through said flat plate portion;

said biting sections being formed into a shape which permits the end of the connection conductor to be interposedly held therebetween and permits said biting sections to bite into the end of the connection conductor when force is applied to the connection conductor in a direction in which the connection conductor is drawn out of said connection conductor holding section;

said contact terminal section including a curved portion which is so formed that a plate-like portion of an elongated shape having a plate surface contiguous to said plate surface of said flat plate portion and connected at a proximal end thereof to said flat plate portion is projected in a direction apart from said peripheral wall of said insulating casing through which said through-hole is formed;

said plate-like portion being formed with a punched hole for providing said biting element of which a distal portion is positioned on a side of said distal end of said plate-like portion; and said contact terminal section further including a pair of interposing portions arranged outside said punched hole to interpose said biting element therebetween and bent toward said distal end of said plate-like portion, to thereby outwardly project said biting element from said punched hole, resulting in providing said contact portion.

5. The electric component as defined in claim 4, wherein said plate-like portion is formed at said curved portion thereof with a slit of an elongated shape so as to extend in a longitudinal direction thereof;

said slit being formed so as to communicate with said punched hole.

6. The electric component as defined in claim 5, wherein said biting element is positioned at said distal end thereof in a virtual plane defined so as to be parallel to said plate surface of said flat plate portion and be in a plane of said flat plate portion.

7. The electric component as defined in claim 6, wherein said virtual plane is so defined that an angle between said virtual plane and said biting element is set to be 45 degrees.

* * * * *